US005320890A

United States Patent [19]

Anton et al.

[11] Patent Number: 5,320,890

[45] Date of Patent: Jun. 14, 1994

[54] FIRE RESISTANT FABRICS WITH A FLOCKED NYLON SURFACE

[75] Inventors: Anthony Anton; Gordon R. Cotman, Jr., both of Wilmington; Herman H. Forsten, Hockessin, all of Del.

[73] Assignee: E. I. Du Pont de Nemours and Company, Wilmington, Del.

[21] Appl. No.: 79,651

[22] Filed: Jun. 23, 1993

[51] Int. Cl.[5] ..... A47C 27/00; B32B 5/08; B32B 5/24; B32B 27/02; B32B 27/34

[52] U.S. Cl. ..... 428/90; 5/457; 427/180; 428/95; 428/97; 428/340; 428/920

[58] Field of Search ..... 428/90, 95, 97, 340, 428/920

[56] References Cited

U.S. PATENT DOCUMENTS

| | | | |
|---|---|---|---|
| 3,968,284 | 4/1976 | George | 428/90 |
| 4,143,197 | 3/1979 | Jaslonowicz et al. | 428/225 |
| 4,396,661 | 8/1983 | George et al. | 428/90 |
| 4,750,443 | 6/1988 | Blaustein et al. | 112/420 |
| 4,927,682 | 5/1990 | Nagura et al. | 428/95 |

*Primary Examiner*—James C. Cannon

[57] ABSTRACT

Spunlaced fabrics from poly(p-phenylene terephthalamide) or mixtures thereof with poly(m-phenylene isophthalamide) fibers having a specified flocked nylon surface can be dyed or printed and the flock does not significantly reduce the fire resistance of the base fabric.

3 Claims, No Drawings

FIRE RESISTANT FABRICS WITH A FLOCKED NYLON SURFACE

BACKGROUND OF THE INVENTION

As a result of a number of serious fires in public buildings, increasingly stringent standards are being developed for materials such as bedding, floor and wall coverings and furniture fabrics. Spunlaced fabrics made from poly(p-phenylene terephthalamide) fibers have been found to meet the full-scale burn requirements of the Boston Fire Department—an industry standard for fire resistance in contract upholstery materials. Useful results are obtained also with fabrics made from blends of fibers from poly(p-phenylene terephthalamide) and poly(m-phenylene isophthalamide). There is a need for comparable flameproof fabrics which can be dyed and/or printed more easily using conventional dyeing and printing procedures.

SUMMARY OF THE INVENTION

The present invention provides a fire-resistant fabric having a flocked surface, comprising a spunlaced base fabric of poly(p-phenylene terephthalamide) fibers or mixtures thereof with up to about 70% by weight of poly(m-phenylene isophthalamide) fibers, said base fabric having a layer of nylon 6 or nylon 6,6 flock upstanding from the base fabric and adhered thereto by means of an adhesive, said flock having a denier per filament of from 0.5 to 1.1, a cut length of from 0.03 to 0.05 inches, preferably about 0.04 inches, and a surface fiber basis weight of from 1.0 to 1.5 oz/yd$^2$.

DETAILED DESCRIPTION OF THE INVENTION

Spunlaced fabric of poly(p-phenylene terephthalamide) is in commercial use as a fire blocker in contract upholstery because of its outstanding flame resistance and excellent thermal properties. This nonwoven fabric is formed by hydraulic needling of a thin mat of staple fiber which is ordinarily formed by air laying the fibers over a screen. The fabric is not readily dyeable, however, since it is being used as a fire blocker underneath or behind another fabric, the inability to dye it is of no great importance. This is not the case for the end-uses contemplated here such as wall covering and upholstery fabrics. For these purposes there is employed a spunlaced fabric having a basis weight of at least 1.5 oz/yd$^2$. Heavier weight fabrics are preferred for furniture upholstery. Lighter weight fabrics are preferred for wall coverings. The spunlaced fabric can be made from 100% poly(p-phenylene terephthalamide) staple or a blend of staple fibers by conventional airlay techniques and then spunlaced according to the general procedures described in U.S. Pat. No. 3,485,786.

To provide a dyeable surface, a nylon flock, i.e., short fiber, is flocked to the surface of the base fabric in a manner commonly employed for making flocked fabric. Nylon fiber may be dyed before being cut into flock or the flock can be attached to the base fabric and dyed or printed. It is important that the flocked surface layer not adversely affect the fire resistant properties of the base fabric to any significant degree. Surprisingly, it has been found that the use of nylon 6 or nylon 6,6 flock having a denier per filament of from 0.5 to 1.1, a cut length of from 0.03 to 0.05 inch, employed at a basis weight of from 1.0 to 1.5 oz/yd$^2$ as the flocked surface on the spunlaced base fabric, provides a flocked fabric that exhibits an After Flame Time that is substantially the same as that exhibited by the base fabric itself in the Vertical Flame Test.

The flock is upstanding from the spunlaced base fabric and is adhered thereto by means of an adhesive that is preferably fire retarded. As is well-known in the production of flocked fabrics, base fabric is first coated with a thin layer of uncured foamed adhesive sufficient to hold the surface flock fiber. The flock fiber, precision cut to the desired length and treated with an electrostatic conductive finish, is deposited in the foamed adhesive material covering the nonwoven substrate. The fabric is then dried and the adhesive cured, prior to final brushing and vacuuming of the pile. No special procedures or equipment is needed for preparing the samples tested in the examples described below. Vertical Flame Test—See ASTM Method No. D-1230-01 - Flammability of Clothing Textiles The terms used to measure the results of this test are defined as follows:

After Flame Time—The time, in seconds, from the removal of the igniting source until the flame extinguishes.

Glow Time—The time, in seconds, in which the specimen continues to glow or smolder after it has ceased to actively flame.

Char Length—The maximum distance, in inches, of damage done by the flame to the specimen.

The standard procedure for conducting the test is as follows:

Ten specimens, each measuring 3-¾×12-½ inches are cut from the fabric. Five are cut parallel to the warp direction and five are cut parallel to the filling direction and the specimens are selected as far apart as possible. These are dried for at least 30 minutes at 105°±2° C. and then placed in a desiccator for at least 15 minutes. A specimen is then placed between halves of a holder which is placed in a cabinet. The flame of a Bunsen burner is adjusted to a height of 1-½ inches. The specimen is positioned so that the bottom is ¾ inch above the top of the burner. The cabinet door is closed and the lighted burner is placed under the center of the specimen. This should be completed within two minutes after the specimen is removed from the desiccator. Two stopwatches are started the instant the flame comes in contact with the specimen.

The flame is withdrawn 12±1 seconds after contact with the specimen. One stopwatch is stopped the instant the flame goes out after removing the burner and recorded as "A". The other stopwatch is stopped when glowing or smoldering ceases and is recorded as "B". After Flame Time is A minus 12 and Glow Time is B minus A.

A prescribed weight is attached to one leg of the specimen opposite the charred area and within ¼ inch of the end of the specimen. The other leg of the specimen is grasped and the specimen and weight are raised clear of the support using a smooth, uniform motion. A tear will progress through the damaged area until undamaged material is reached. The length of this tear is the Char Length.

The weights for use in determining Char Length are selected as follows:

| Weight of Fabric (oz./sq. yd.) | Weight for Char Length Measurement (lbs.) |
|---|---|
| 2–6 | 0.25 |
| 6–15 | 0.50 |
| 15–23 | 0.75 |
| Above 23 | 1.00 |

EXAMPLE

This example describes the preparation of the fabric of the invention and demonstrates its unique performance in the vertical flame test. The nylon 6,6 flock was prepared from 1.1 denier-per-filament (dpf) uncrimped tow which was processed and precision cut to 0.04 inch cut length flock using a standard commercial procedure. The elements of flocking are described in a booklet entitled "Flocking" offered by the American Flock Association, 230 Congress Street, Boston, Mass., 02110. A flocked fabric sample was made from a 9 ½×11 ¼ inch swatch of a 2 oz/yd$^2$ spun-laced non-woven 100% poly(p-phenylene terephthalamide) (PPD-T) (from E. I. du Pont de Nemours and Company). The fabric was thinly coated (2–2.5 oz/yd$^2$) with a water thinned fire retardant-containing flocking adhesive (coded FF1006F from Key Polymer, Inc., Lawrence, Mass. 01842-1527). This particular adhesive contains carboxylated acrylic latices and a brominated antimony compound. The nylon flock was electrostatically applied and the fabric was placed in a drying oven to cure the adhesive. The amount of nylon flock on the surface of the substrate is determined by a method in which the nylon flock of a weighed sample is dissolved in hydrochloric acid solution and the undissolved PPD-T substrate (with the adhering cured adhesive) is rinsed, dried and reweighed. The % surface nylon is calculated as the percent fiber dissolved based on total fabric weight. The following were the results:

| Sample | Total Fabric Weight grams/inch$^2$ | Total Fabric Weight oz/yd$^2$ | % Surface Nylon | Nylon oz/yd$^2$ |
|---|---|---|---|---|
| A | 0.130 | 5.4 | 16.15 | 0.87 |

The uniqueness of the fabric construction so defined in minimizing flammability was demonstrated by preparing another fabric Sample B, which had the same substrate and adhesive, but instead, employed a 3 dpf nylon 6,6 flock. The flock for Sample B was prepared from an uncrimped tow which was cut into 0.05 inch cut length flock. The weight of the fabric was 6.9 oz/yd$^2$ and the surface nylon, 1.8 oz/yd$^2$. The Vertical Flame results attest to the uniqueness of the invention described:

| Sample | After Flame Time (sec.) | Glow Time (sec.) | Char Length (inches) | Observation |
|---|---|---|---|---|
| A | 0 | 3 | 3.38 | Fire went out as soon as flame was removed |
| B | 52 | 2 | 10 | Nylon burned causing substrate to char |

The above results are surprising since it would be expected that fine (1.1 dpf) filaments would burn more readily than the thicker (3 dpf) filaments.

About 20 yards of fabric with the composition of Sample A was successfully made on a commercial flock range and the nylon surface successfully printed on a commercial screen print range using conventional procedures as practiced by the trade. The Vertical Flame test results of the printed fabric, Sample C, was similar to that of Sample A.

| Sample | Sampled | After Flame Time (sec.) | Glow Time (sec.) | Char Length (inches) |
|---|---|---|---|---|
| C | a. along width | 0 | 5.3 | 3.8 |
| | b. across width | 0 | 4.5 | 3.6 |

We claim:

1. A fire-resistant fabric having a flocked surface comprising a spunlaced base fabric of poly(p-phenylene terephthalamide) fiber or mixtures thereof with up to 70% of poly(m-phenylene isophthalamide) fiber, said base fabric having a layer of nylon 6 or nylon 6,6 flock upstanding from the base fabric and adhered thereto by means of an adhesive, said flock having a denier per filament of from 0.5 to 1.1, a cut length of from 0.03 to 0.05 inches, and a surface fiber basis weight of from 1.0 to 1.5 oz/yd$^2$.

2. A fire-resistant fabric according to claim 1 wherein the adhesive is fire retarded.

3. A fire-resistant fabric according to claim 1 wherein the flock has a cut length of about 0.04 inches.

* * * * *